US005225811A

United States Patent [19]

Audy

[11] Patent Number: 5,225,811

[45] Date of Patent: Jul. 6, 1993

[54] TEMPERATURE LIMIT CIRCUIT WITH DUAL HYSTERESIS

[75] Inventor: Jonathan M. Audy, Campbell, Calif.

[73] Assignee: Analog Devices, Inc., Norwood, Mass.

[21] Appl. No.: 830,619

[22] Filed: Feb. 4, 1992

[51] Int. Cl.[5] ..... G08B 17/06

[52] U.S. Cl. ..... 340/584; 307/117; 340/661; 340/662; 340/663

[58] Field of Search ..... 340/584, 661, 662, 663; 307/117

[56] References Cited

U.S. PATENT DOCUMENTS 4,994,792 2/1991 Ziegler, Jr. ..... 340/584

OTHER PUBLICATIONS

Precision Monolithics Inc., 1988, *Analog IC Data Book*, pp. 8-36 through 8-42.

*Primary Examiner*—Glen R. Swann, III

*Attorney, Agent, or Firm*—Koppel & Jacobs

[57] ABSTRACT

A temperature limit circuit has a pair of comparators for producing an output signal when a sensed temperature either exceeds of falls below a permissible range. A common impedance circuit uses a single output pin to establish both the upper and lower temperature limits and a hysteresis level at each end of the range. A hysteresis circuit includes two branches, one of which directs a hysteresis current in one direction to a hysteresis resistor at a common input to the comparators to set the hysteresis at one end of the temperature range, and the other of which directs the hysteresis current through the hysteresis resistor in the opposite direction to set the hysteresis at the other end of the temperature range; the oppositely directed current flows establish hysteresis differentials of opposite polarities. A voltage reference circuit that includes a feedback circuit is preferably used for both temperature sensing and to establish a reference current upon which the hysteresis current is based. An isolation circuit emulates the feedback circuit and isolates the hysteresis current from the feedback current.

24 Claims, 2 Drawing Sheets

TEMPERATURE LIMIT CIRCUIT WITH DUAL HYSTERESIS

BACKGROUND OF THE INVENTION

1. Field of the Invention

This invention relates to temperature sensitive circuits that provide a signal when the temperature exceeds predetermined limits, and more particularly to such circuits that have a hysteresis capability which holds the signal on until the temperature has returned into the permissible range by a hysteresis differential.

2. Description of the Prior Art

It would be desirable to provide a temperature sensitive circuit that generates a warning signal when the device is either above or below a specific temperature range. Such a device would also preferably have a hysteresis capability such that the warning signal is not discontinued immediately when the temperature returns to the permissible range, but rather stays on until the temperature has continued into that range by a hysteresis differential. This prevents a jittering of the circuit's output when the temperature is hovering at the limit of the permissible range and intermittently slips into and out of that range, and also provides a longer warning signal when an over- or under-temperature situation has occurred.

Comparator circuits are presently available with a hysteresis capability that can be either designed into the unit, or selected by the user through the addition of external feedback circuitry. A comparator provides a logic output that indicates the amplitude relationship between two analog signal inputs; an output signal is produced when the differential between the two input signals exceeds a predetermined amount. The COMP-08 high-speed comparator by Analog Devices, Inc., the assignee of the present invention, is an example of such a device. Its hysteresis capability is useful in providing sharp output transitions even when the slew rates of its inputs are relatively slow, and in reducing the likelihood of invalid output transitions due to noise.

A schematic diagram of the COMP-08 hysteresis circuitry is provided in FIG. 1. The comparator itself is designated by numeral 2, with a variable input applied at input terminal 4 and a reference input applied through resistor Ra at input terminal 6. The comparator output is delivered to an output terminal 8, while a complementary output is connected back to its reference input through a feedback resistor Rb. Equal value pulldown resistors RL1 and RL2 are connected respectively from the comparator's output and its complementary output to a termination voltage $V_T$ terminal 10. With Ra equal to 10 ohms and Rb equal to 4.7 kohms, switching points at input voltages of −1.1 mV and −3.9 mV are typically obtained. The hysteresis trip points may be offset by connecting Ra to a reference voltage other than ground.

While the described comparator is suitable for its intended purpose, it merely compares a variable input voltage to a reference, rather than signaling when the temperature has exceeded either the upper or lower limits of a desired temperature range. Even if the variable input signal represented temperature, the circuit would produce an output signal only when the input exceeded one end of a temperature range, not both ends. The hysteresis circuitry is likewise applicable to only one end of a temperature range.

While an aggregation of comparators and respective hysteresis circuits might be envisioned that collectively produce warning signals when either end of a given temperature range is exceeded, it would be very useful to be able to vary the amount of hysteresis at will. However, the addition of a new function such as hysteresis settability typically requires the dedication of an output pin to that function. Since the number of available pins on a given device is often quite limited and all of the pins might already be required for some other purpose, as a practical matter the device may be unable to accommodate a user-controlled hysteresis capability.

SUMMARY OF THE INVENTION

The present invention seeks to provide a temperature limit circuit that produces a signal whenever a sensed temperature exceeds either the upper or lower limits of a selectable temperature range, and that has a hysteresis capability at both ends of the selected range. Despite the availability of a double-ended hysteresis, the required number of output pins should not be increased. The hysteresis magnitudes should be within the user's control, including a zero hysteresis option, and a hysteresis cancellation is sought in the event the selected hysteresis value exceeds the device's temperature range.

The invention uses a temperature sensor and two comparators, one to produce an over-temperature signal when the sensed temperature exceeds a selectable upper set point and the other to produce an under-temperature signal when the sensed temperature falls below a lower selectable set point. A common impedance circuit is used to establish both the upper and lower temperature set points and a hysteresis at both ends of the permissible temperature range.

In the preferred embodiment the impedance circuit is connected to the output node of a voltage reference circuit to establish a reference current. A hysteresis circuit then sets up a hysteresis current that is based upon the reference current. The hysteresis circuit includes two branches, one of which is actuated when the upper temperature set point is exceeded and the other of which is actuated when the temperature falls below the lower set point. The direction of the hysteresis current depends upon which branch is actuated; the polarity of the hysteresis is in turn controlled by the hysteresis current direction so that the hysteresis polarity is properly matched with the set point that has been exceeded.

The preferred voltage reference circuit includes a feedback circuit that draws a feedback current from the voltage reference output node. To compensate for this feedback current and isolate the hysteresis current from it, an isolation circuit supplies a feedback emulation current to the voltage reference output node. If desired the emulation current can be set higher than the feedback current so as to effectively cancel the hysteresis current, and thereby eliminate the hysteresis feature in a particular application. A cancellation of hysteresis currents is also provided for in the event the selected hysteresis value exceeds the permissible temperature range.

The voltage reference is preferably implemented by a bandgap reference circuit that, in addition to the reference voltage, produces a voltage with a positive temperature coefficient. The latter voltage is used as a temperature input for the comparators.

The comparator set points are established by tapping the impedance circuit at appropriate points and applying respective tap voltages to the two comparators. The other inputs to the comparators are connected in common to a hysteresis impedance through which the hysteresis current is directed. Both the temperature limit set points and the amount of hysteresis are thus controlled by the same impedance circuit, so that only a single output pin is required to accomplish both functions.

These and further features and objects of the invention will be apparent to those skilled in the art from the following detailed description, taken together with the accompanying drawings, in which:

DETAILED DESCRIPTION OF PREFERRED EMBODIMENTS

The present invention uses a single output pin to establish both the upper and the lower temperature set points of a desired temperature range, and to enable the user to select hysteresis levels for the two set points. This is accomplished with a common hysteresis circuit that forms part of a dual comparator network.

Figure 1:
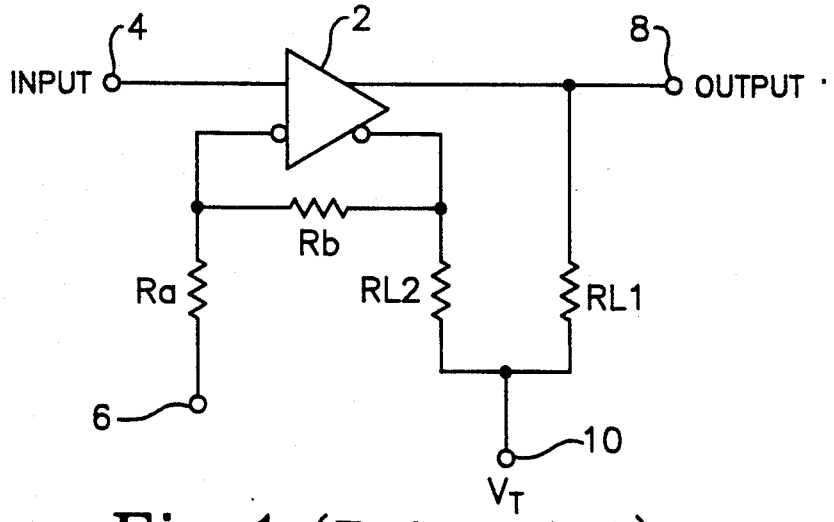
Fig.1 (Prior Art)
FIG. 1 is a schematic diagram of a hysteresis circuit for a prior comparator circuit, described above.
Figure 2:
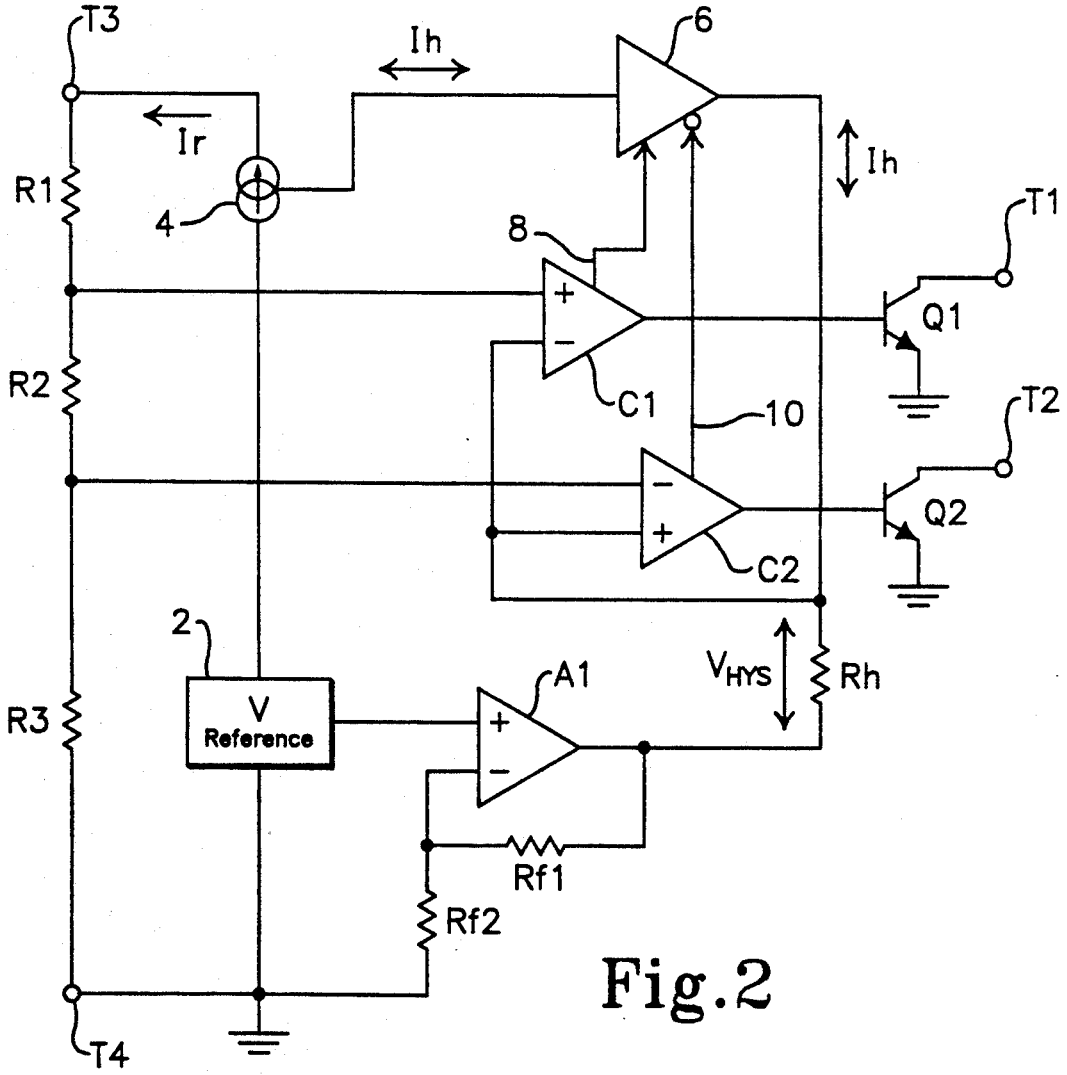
FIG. 2 is a block diagram of a temperature limit circuit with a dual polarity hysteresis capability in accordance with the invention.

A simplified block diagram of a preferred embodiment is given in FIG. 2. The circuit includes a pair of comparators C1 and C2, with C1 producing an output signal at terminal T1 through output transistor Q1 when the temperature exceeds an over-temperature set point, and comparator C2 producing an output signal at terminal T2 through output transistor Q2 when the temperature falls below an under-temperature set point. The set points are established by a series impedance circuit consisting of resistors R1, R2 and R3, with the positive input to comparator C1 connected to the junction of R1 and R2 and the negative input of C2 connected to the junction of R2 and R3. A reference voltage level is applied to terminal T3 at the R1 end of the series resistance circuit by a voltage reference circuit 2, while a lower reference voltage level (preferably ground) is applied to terminal T4 at the opposite end of the resistance circuit.

While the resistors R1, R2, R3 could be integrated into the remainder of the circuitry, they are preferably added by the user as externally connected elements. For this purpose terminal T3 is implemented as an output pin to which external connections can be made. The resistance circuit functions as a voltage divider, with the voltage at the R1/R2 junction establishing an upper set point for comparator C1 and the voltage at the R2/R3 junction establishing a lower set point for comparator C2. Typical resistance values are 50 kohms for R1 and 100 kohms each for R2 and R3, while a typical reference voltage is 2.5 volts. As explained below the total series resistance establishes a reference current that is used to set the amount of hysteresis for the comparator operation. If more hysteresis is desired, for example, the resistance values can all be reduced to increase the reference current through the resistance circuit; if at the same time a retention of the same comparator set points is desired, the relative values of the three resistors can be held constant so that their voltage divider effect remains unchanged. Conversely, the relative values of the three resistors can be changed without changing their total series resistance if it is desired to change the comparator set points without changing the amount of hysteresis associated with each set point.

A voltage signal that varies with temperature is applied in common to the negative input of comparator C1 and to the positive input of comparator C2. When the temperature voltage signal exceeds the set point voltage at the positive input to C1, that comparator produces an output over-temperature warning signal that appears at terminal T1 after amplification by the transistor Q1; an under-temperature warning signal is produced by comparator C2, amplified by transistor Q2 and applied to terminal T2 when the temperature voltage signal falls below the set point voltage at the negative input to C2.

Although a separate temperature sensing element could be provided, in the preferred embodiment the voltage reference 2 is implemented as a bandgap voltage reference in which one node supports a voltage that has a positive temperature coefficient (further discussion of bandgap voltage references is provided below). The temperature-dependent voltage at that node is amplified by an operational amplifier A1 that includes feedback resistors Rf1 and Rf2, and applied to one end of a hysteresis-setting impedance circuit that is preferably implemented as a resistor Rh. The other side of resistor Rh is connected as the common temperature input to comparators C1 and C2.

The current established by the voltage reference 2 through the temperature limit setting resistors R1, R2, R3 is referred to herein as the reference current Ir. A current mirror circuit 4 senses the reference current and generates a hysteresis current Ih that controls the amount of hysteresis added to the temperature limit circuit's operation. The hysteresis current Ih is routed to a bidirectional current gate 6 that is normally nonconductive. The operation of current gate 6 is controlled by complementary outputs 8 and 10 provided from comparators C1 and C2, respectively; when neither comparator is producing an output their complementary outputs 8 and 10 are grounded and hold the gate 6 off. When the temperature exceeds the over-temperature set point of comparator C1, the comparator's output goes high and its complementary output 8 is released. This actuates the current gate 6 to allow a flow of the hysteresis current Ih towards the hysteresis resistor Rh, which in turn produces a voltage drop across Rh and increases the voltage at the temperature inputs to comparators C1 and C2. The result of the increased temperature input to the comparators is that the output from over-temperature comparator C1 is held on as the actual temperature falls back below the upper temperature set point, and remains on until the actual temperature has dropped to a level at which the difference between the temperature-dependent voltage signal at the output of amplifier A1 and the upper set point voltage equals the hysteresis voltage across Rh. Any further reduction in the actual temperature causes the voltage at the negative input of C1 to fall below the upper set point voltage, turning C1 off. This in turn terminates the over-temperature signal, and also restores the current gate 6 to its normal off status.

The circuit's response to an under-temperature condition is similar, but is based upon an opposite direction of flow for the hysteresis current. When the temperature falls below the lower set point, the under-temperature comparator C2 is actuated and causes an under-temperature signal to appear at terminal T2. At the same time its complementary output 10 is released, causing current gate 6 to conduct the hysteresis current Ih in the opposite direction from the over-temperature condition, up through the hysteresis resistor Rh and away from the output of the voltage reference amplifier A1. This produces a voltage drop across Rh that lowers the voltage at the positive temperature input to comparator C2. As a result the actual temperature must increase above the lower set point level, until it exceeds the lower set point by an amount equal to the hysteresis voltage across Rh, before C2 can reset to its original condition and remove the under-temperature signal from terminal T2.

The common hysteresis circuitry thus provides both a positive hysteresis that is added to the actual temperature before an over-temperature warning signal can be terminated, and a negative hysteresis that is subtracted from the actual temperature before an under-temperature warning signal can be terminated. The amount of hysteresis is under the control of the user, and can be adjusted by changing the total series resistance of the user-selected resistors R1, R2, R3; this changes the reference current Ir and thus the hysteresis current Ih. Furthermore, since the same output pin T3 that is used to select the comparator set points is also used to establish the reference current and thus the hysteresis current, the hysteresis feature does not require a dedicated output pin and can thus be incorporated into the temperature limit circuit without forcing the elimination of any other features.

Figure 3:
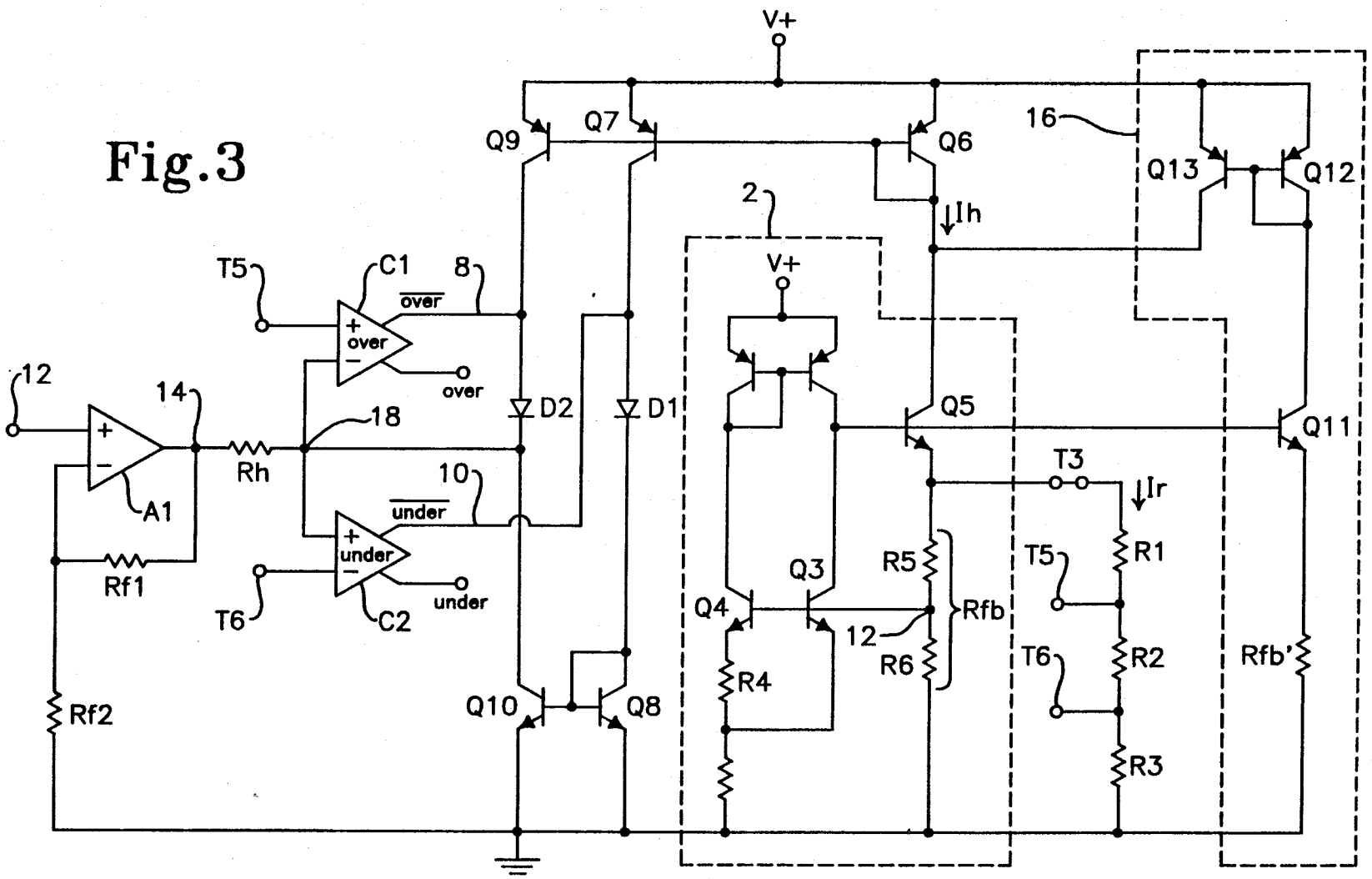
FIG. 3 is a more detailed schematic diagram of the circuit of FIG. 2.

FIG. 3 is a more detailed schematic diagram of the circuit illustrated in block diagram form in FIG. 2, with the same reference numerals used for common elements. The circuit is operable at least over the standard temperature range of −55° C. to ±125° C. The voltage reference circuit 2 is shown implemented as a bandgap reference circuit referred to as a Brokaw cell. This type of circuit operates by summing voltages with positive and negative temperature coefficients to yield a stable output voltage over temperature. A differential base-emitter junction voltage established at node 12 between two transistors Q3 and Q4, which are operated at different current densities because of the addition of a resistor R4 in the emitter circuit of one of the transistors, exhibits a positive temperature coefficient; the base-emitter junction voltage of a single npn transistor Q5 exhibits a negative temperature coefficient. Node 12 is connected to the emitter of transistor Q5 through a resistor R5 such that the negative temperature coefficient of the Q5 base-emitter circuit and the positive temperature coefficient of the node 12 voltage cancel to produce a constant, temperature-independent reference voltage at the emitter of Q5; this voltage is applied to the reference voltage terminal T3. Node 12 is also connected to a ground reference through another resistor R6, with the two series resistors R5 and R6 collectively constituting the output feedback resistor Rfb for the voltage reference circuit.

The positive temperature coefficient voltage at node 12, which may be taken as an indication of the prevailing temperature, is amplified by operational amplifier A1 to yield a temperature dependent voltage signal at the output node 14 of amplifier A1. It is this signal that is applied through hysteresis resistor Rh to the negative input of over-temperature comparator C1 and the positive input of under-temperature comparator C2.

The circuitry that establishes the hysteresis current will now be described. In the preferred embodiment it includes a compensation circuit 16, shown enclosed in dashed lines, that can be used to compensate for the current drawn by the feedback resistance Rfb in setting up the hysteresis current; if desired it can also be used to reduce or even cancel the hysteresis effect. However, the hysteresis current circuit will first be described in the absence of the compensation circuit 16.

Ignoring base currents, the base-emitter circuit of the voltage reference output transistor Q5 supplies both the reference current Ir for the set point resistors R1, R2, R3 and the reference circuit feedback current through feedback resistance Rfb. This current is delivered to Q5 from a current source that is implemented by a diode-connected current supply transistor Q6, which in turn is supplied by a positive voltage bus V+ (typically 5 volts). Transistor Q6 roughly corresponds to the current source 4 in FIG. 2; the current it supplies to transistor Q5 is the hysteresis current Ih.

The hysteresis circuit includes two branches, one consisting of a transistor Q7, diode D1 and diode-connected transistor Q8 connected in series, and the other branch consisting of a transistor Q9, diode D2 and transistor Q10 connected in series. The bases of both transistors Q7 and Q9 are connected in common with the base of current source transistor Q6 so that Q7 and Q9 mirror the current through Q6. While the currents in both branches will normally be equal, Q7 and Q9 may be given different scalings if desired to offset their currents from each other and thus make the magnitude of the upper set point hysteresis different from the lower set point hysteresis.

The complementary output 8 of the over-temperature comparator C1 is connected to the anode of diode D2, while the complementary output 10 of the under-temperature comparator C2 is connected to the anode of diode D1. The opposite end (node 18) of hysteresis resistor Rh from node 14 is connected to the cathode of diode D2 as well as to the negative input of C1 and the positive input of C2, and the bases of transistors Q8 and Q10 are tied together.

In FIG. 3 the external resistors R1, R2, R3 are shown removed from the comparators C1 and C2. However, the junction T5 between R1 and R2 is still connected to the positive input to C1 to establish the upper set point, while the junction T6 between R2 and R3 is still connected to the negative input to C2 to establish the lower set point.

To describe the operation of the hysteresis circuit, first assume that the actual temperature is within the limits established by comparators C1 and C2. In that event both of the complementary outputs 8 and 10 of comparators C1 and C2 are grounded, preventing hysteresis current from flowing either from Q7 or Q9 through their respective branch diodes D1 and D2. Rather, the Q7 and Q9 currents are routed to ground through the complementary outputs of C2 and C1, respectively. No current flows through hysteresis resistor Rh, and the voltage at the common node 18 temperature input to the comparators is determined solely by the actual temperature.

Assume now that the temperature rises above the upper set point of comparator C1. This causes an output to be produced by C1 and releases the complementary output of C1, allowing the current from Q9 to flow through D2. However, the complementary output of C2 remains grounded, diverting the Q7 current away from D1. Since no current flows through D1 there is likewise a zero current flow through Q8, and this in turn prevents any current from flowing through its mirroring transistor Q10. The hysteresis current through D2 is thus diverted to flow through the hysteresis resistor Rh from node 18 to node 14. Since the voltage at node 14 is fixed for a given temperature, the current through Rh causes the voltage at the node 18 input to comparator C1 to rise by an amount equal to the resistance value of Rh times the hysteresis current magnitude. The increase in its negative input voltage drives C1 harder on, and holds it on until the temperature-controlled voltage at node 14 has dropped below the set point of C1 by a hysteresis differential equal to the voltage across Rh. A hysteresis effect in the operation of over-temperature comparator C1 is thus introduced.

Assume next that the temperature has fallen to below the set point of under-temperature comparator C2. The comparator switches on, releasing its complementary output so that the current from Q7 can now flow through D1 and Q8. The Q8 current is mirrored by Q10. However, comparator C1 is off and its complementary output is grounded, diverting the Q9 current away from D2. Since no current flows through D2, the Q10 current is supplied from the output node 14 of amplifier A1 through the hysteresis resistor Rh. This hysteresis current flows from node 14 to node 18, and causes the voltage level at the node 18 positive input to comparator C2 to drop. As a result comparator C2 is driven harder on, and the temperature must increase above the under-temperature set point of C2 by an amount equal to the hysteresis differential set by the voltage across Rh, before C2 can turn off and terminate its under-temperature signal.

The amount of hysteresis is directly related to the voltage differential across Rh. Generally about 1° C. of hysteresis results from each 2.5 mV across Rh. With a typical value for Rh of 500 ohms, each 5μA of hysteresis current Ih corresponds to about 1° C. of hysteresis.

One advantage of the described circuit is that it automatically cancels the hysteresis in the event the hysteresis differential exceeds the difference between the over-temperature and under-temperature set points. This can occur, for example, if the difference between set points is 2° and the desired hysteresis differential is 1.9°, but because of processing tolerances or the like the actual hysteresis is 2.1°. If the temperature first exceeds the upper set point, hysteresis current will flow from Q9 and D2 through Rh from node 18 to node 14 as described above. If the temperature then falls below the lower set point but is still within the hysteresis differential for the upper set point, current will continue to flow through Q9 and D2 but the additional actuation of comparator C2 will also cause hysteresis current to flow through Q7, D2 and Q8. The current through Q8 is mirrored by Q10 so that the D2 current now flows through Q10 rather than Rh. Balanced current flows are thus established in both hysteresis circuit branches, and no current flows through Rh. This hysteresis current cancellation for Rh reduces the voltage at node 18 and allows C1 to turn off, whereupon the circuit reverts to its normal under-temperature hysteresis operation. A similar momentary hysteresis cancellation, followed by a reversion to normal operation, occurs if the temperature first drops below the under-temperature set point and then increases to a level that is above the over-temperature set point but still within the under-temperature hysteresis differential.

Whereas the hysteresis varies directly with Rh, it has an inverse but disproportional relationship to the set point resistors R1, R2, R3 in the circuit described thus far. The R1, R2, R3 series resistance is connected in parallel with the voltage reference feedback resistance Rfb. Thus, any change in the total series resistance of R1, R2, R3 will change the hysteresis current through Q6 and Rh, but the percentage change in the hysteresis current will be less than the percentage change in the series resistance. (Although R1, R2, R3 have been described thus far as user selected, they could also be implemented as potentiometers that are provided by the manufacturer as integral parts of the temperature limit circuitry, in which case the user can select desired resistance values simply by adjusting the potentiometers.) With a typical voltage reference feedback resistance Rfb of 50 kohm compared to a typical total series resistance for R1, R2, R3 of 250 kohm, a considerably larger relative change in the series resistance is required to produce a given relative change in the hysteresis current.

The compensation circuit 16 is preferably provided to effectively isolate the hysteresis circuit from the feedback resistance Rfb, and thereby allow for a proportional inverse relationship between the R1, R2, R3 impedance circuit and the amount of hysteresis. The compensation circuit emulates the current drawn by the feedback resistor Rfb and subtracts it from the total current drawn by the R1, R2, R3/Rfb parallel circuit, thereby leaving a resultant hysteresis current through Q6 equal to the reference current Ir through R1, R2, R3. For this purpose the compensation circuit includes a resistor Rfb', transistor Q11 and diode-connected transistor Q12 that are connected in series and respectively emulate Rfb, Q5 and Q6. With the bases of Q5 and Q11 connected in common and the emulation circuit connected in parallel with the R1, R2, R3, Q5, Q6 circuit, the current flowing through the emulation circuit equals the current through Rfb. The emulation current is mirrored by a transistor Q13 that has a common base connection with Q12, and routed to the junction of Q5 and Q6. The total current flowing through Q5 is thus the sum of the emulation current from compensation circuit 16 and the hysteresis current from Q6. Since the emulation current is set equal to the current through Rfb, the hysteresis current equals the reference current Ir through R1, R2, R3.

The compensation circuit 16 also resolves another potential limitation of the temperature limit circuit. With a typical reference voltage of 2.5 volts at the reference output terminal T3 and Rfb equal to 50 kohms, the current through Rfb will be 50 μA. This equates to a minimum hysteresis value of 10° C., even with no current through R1, R2, R3, in the absence of the compensation circuit. This hysteresis offset could theoretically be reduced by reducing the series resistance of R1, R2, R3, to increase Ir relative to the Rfb current, and thus make the hysteresis value more dependent upon the value of Ir. In this event, however, the circuit's total power consumption would be unnecessarily increased.

If it is desired to operate the temperature limit circuit without any hysteresis, the value of Rfb' can be adjusted so that the emulation current delivered to the collector-emitter circuit of Q5 equals the sum of Ir and the current through Rfb. In this manner the hysteresis current through Q6 can be set at zero. Another approach would be to leave the emulation current equal to the current through Rfb but to significantly increase the resistance values of R1, R2, R3 until Ir becomes very small. However, making R1, R2, R3 too large causes the temperature limit circuit's over-temperature and under-temperature set points to be inaccurate due to the finite input base currents of the comparators multiplied by the equivalent input resistance of R1, R2, R3.

Different embodiments of a temperature limit circuit that responds to a sensed temperature either exceeding or falling below a permissible range, with an adjustable hysteresis at each end of the range and a capability of adjusting the temperature limit set points, and in which a single output pin is used to both establish the set points and to select the hysteresis value, have thus been shown and described. As numerous variations and alternate embodiments will occur to those skilled in the art, it is intended that the invention be limited only in terms of the appended claims.

I claim:

1. A temperature limit circuit, comprising:

a temperature sensing means, first comparator means for producing an over-temperature signal when the sensed temperature exceeds an upper set point, second comparator means for producing an under-temperature signal when the sensed temperature falls below a lower set point, a hysteresis circuit for establishing a hysteresis signal to terminate said over-temperature signal when the second temperature falls from said upper set point to a hysteresis differential below said upper set point, and to terminate said under-temperature signal when the sensed temperature increases from said lower set point to a hysteresis differential above said lower set point, and a common impedance circuit that establishes both said upper and lower set points and the value of said hysteresis differential.

2. A temperature limit circuit, comprising:

a temperature sensing means, first comparator means for producing an over-temperature signal when the sensed temperature exceeds an upper set point, second comparator means for producing an under-temperature signal when the sensed temperature falls below a lower set point, and a hysteresis circuit for establishing a hysteresis signal to terminate said over-temperature signal when the sensed temperature falls from said upper set point to a hysteresis differential below said upper set point, and to terminate said under-temperature signal when the sensed temperature increases from said lower set point to a hysteresis differential above said lower set point, said hysteresis circuit cancelling said hysteresis if said differential exceeds the difference between said upper and lower set points and the sensed temperature undergoes an excursion from beyond one to beyond the other of the set points.

3. The temperature limit circuit of claim 2, wherein said hysteresis circuit establishes a hysteresis current the magnitude of which determines the magnitude of said hysteresis differential and the direction of which determines the polarity of said hysteresis differential, said over-temperature and under-temperature signals cause said hysteresis current to flow in respective opposite directions, and the simultaneous presence of said over-temperature and under-temperature signals substantially cancels said hysteresis current.

4. The temperature limit circuit comprising:

a temperature sensing means, first comparator means for producing an over-temperature signal when the sensed temperature exceeds an upper set point, second comparator means for producing an under-temperature signal when the sensed temperature falls below a lower set point, and second comparator means for producing an under-temperature signal when the sensed temperature falls below a lower set point, and a hysteresis circuit for establishing a hysteresis signal to terminate said over-temperature signal when the sensed temperature falls from said upper set point to a hysteresis differential below said upper set point, and to terminate said under-temperature signal when the sensed temperature increases from said lower set point to a hysteresis differential above said lower set point, said hysteresis circuit establishing a hysteresis current the magnitude of which determines the magnitude of said hysteresis differential and the direction of which determines the polarity of said hysteresis differential, and said over-temperature and under-temperature signals causing said hysteresis current to flow in respective opposite directions.

5. A temperature limit circuit, comprising:

a voltage reference circuit having a voltage reference output node, an impedance circuit connected to the voltage reference output node to establish a reference current, a temperature sensitive circuit for producing over-temperature and under-temperature signals when a sensed temperature respectively exceeds and falls below upper and lower temperature set points, a current controlled hysteresis circuit for maintaining said over-temperature and under-temperature signals until the sensed temperature respectively drops below and exceeds said upper and lower set points by a hysteresis differential, and means for establishing a hysteresis current for said hysteresis circuit based upon said reference current, the magnitude of said hysteresis current determining the magnitude of said hysteresis differential.

6. The temperature limit circuit of claim 5, wherein said impedance circuit is connected to said temperature sensitive circuit to establish said upper and lower set points.

7. The temperature limit circuit of claim 5, said voltage reference circuit including a feedback circuit connected to said voltage reference output node and drawing a feedback current therefrom wherein said means for establishing a hysteresis current includes isolation circuit means for isolating said hysteresis current from said feedback current so that the hysteresis current is based upon said reference current substantially exclusive of said feedback current.

8. The temperature limit circuit of claim 7, wherein said isolation circuit includes means for establishing a current that emulates said feedback current, and means for supplying said emulation current to said voltage reference output node to substantially cancel the effect of said feedback current upon said hysteresis current.

9. The temperature limit circuit of claim 8, wherein said emulation current means establishes said emulation current at a level greater than said feedback current, and said impedance circuit is selectable to allow said emulation current to substantially cancel the effect of said reference current upon said hysteresis current along with said feedback current cancellation, thereby permitting said hysteresis to be selectively cancelled.

10. The temperature limit circuit of claim 5, wherein said temperature sensitive circuit comprises a temperature sensing means, an over-temperature comparator connected in circuit with said temperature sensing means to produce an over-temperature signal when the sensed temperature exceeds said upper set point, and an under-temperature comparator connected in circuit with said temperature sensing means to produce an under-temperature signal when the sensed temperature falls below said lower set point, and said hysteresis circuit includes means for supplying said hysteresis current in one direction to establish a hysteresis below said upper set point when the sensed temperature exceeds said upper set point, and in the opposite direction to establish a hysteresis above said lower set point when the sensed temperature falls below said lower set point.

11. The temperature limit circuit of claim 10, wherein said comparators include complementary outputs that are connected to control the direction of said hysteresis current.

12. The temperature limit circuit of claim 11, said hysteresis circuit including first and second branches for directing said hysteresis current in respective opposite directions, said complementary comparator outputs being connected to said branches to actuate the branch whose direction of hysteresis current flow corresponds to a prevailing over-temperature or under-temperature condition, and to de-actuate the other branch.

13. The temperature limit circuit of claim 12, wherein said branches are connected in parallel between first and second voltage buses, each branch includes a diode for conducting current from the first towards the second voltage bus and a mirrored current source for directing said hysteresis current towards its respective diode, said complementary comparator outputs are connected to respective ones of said diodes to inhibit current flow through one diode when said comparators are in an over-temperature output state and to inhibit current flow through the other diode when said comparators are in an under-temperature output state, said branches further include respective current mirror means on the opposite side of their diodes from their mirrored current sources for mirroring the current in said first branch to said second branch, and said second branch is connected between its diode and its current mirror means to provide said hysteresis current to said temperature sensitive circuit, the direction of said hysteresis current relative to said temperature sensitive circuit and thereby the polarity of the hysteresis being determined in accordance with which diode's current flow has been inhibited.

14. The temperature limit circuit of claim 5, said voltage reference circuit comprising a bandgap reference circuit that produces a voltage with a positive temperature coefficient for said temperature sensitive circuit in addition to a substantially temperature-independent reference voltage.

15. A temperature limit circuit, comprising:

a temperature sensing means, over-temperature and under-temperature comparators, a hysteresis impedance circuit connected in circuit with said temperature sensing means to provide a common temperature input to each of said comparators, a voltage reference circuit having an output reference voltage node, a voltage dividing impedance circuit connected to said output reference voltage node and drawing therefrom a reference current, means tapping said voltage dividing impedance circuit to provide over-temperature and under-temperature set points for said over-temperature and under-temperature comparators, respectively, means for establishing a hysteresis current that is based upon said reference current, first and second hysteresis circuit branches, each circuit branch including a current source for supplying said hysteresis current to its respective branch, a diode for transmitting the current from its current source, and a current mirror means on the opposite side of the diode from said current source, the current mirror means for the second branch mirroring the current through the current mirror means for the first branch, means connecting said hysteresis impedance circuit and the common temperature inputs of said comparators to said second branch to receive current from the second branch's diode and to supply current to its current mirror means, and complementary outputs from said comparators connected to inhibit current flow through the diode for one branch when one of said comparators is actuated and to inhibit current flow through the diode for the other branch when the other of said comparators is actuated, and thereby direct hysteresis current flows through said hysteresis impedance circuit which reduce the temperature necessary to de-actuate said over-temperature comparator by a hysteresis differential and increase the temperature necessary to deactuate said under-temperature comparator by substantially the same hysteresis differential.

16. The temperature limit circuit of claim 15, said means for establishing a hysteresis current comprising a supply diode connected to supply said reference current to said output reference voltage node, said current sources being connected to mirror the current through said supply diode.

17. The temperature limit circuit of claim 16, wherein the complementary outputs from the under- and over-temperature comparators are connected to the anodes of the diodes in said first and second hysteresis circuit branches, respectively, actuation of said under-temperature comparator causing hysteresis current to flow through the second branch diode and into said hysteresis impedance circuit in one direction, and actuation of said over-temperature comparator causing hysteresis current to flow out of said hysteresis impedance circuit in the opposite direction and through said second branch current mirror means.

18. The temperature limit circuit of claim 16, said voltage reference circuit including a feedback impedance connected to said voltage reference output node and drawing a feedback current therefrom, wherein said means for establishing a hysteresis current further comprises means for emulating said feedback current, and means for supplying said emulated current to said voltage reference output node to substantially compensate for said feedback current and thereby effectively isolate the hysteresis current from the feedback current.

19. The temperature limit circuit of claim 18, wherein said emulated current exceeds said feedback current by an offset amount, and said voltage dividing impedance circuit is selectable to equalize said reference and offset currents, thereby permitting said hysteresis to be selectively cancelled.

20. The temperature limit circuit of claim 18, wherein said voltage reference circuit includes an output transistor having a control node and connected to supply said feedback current, said emulating means comprises a transistor that emulates said output transistor and has a control node connected in common with the output transistor's control node, an impedance that emulates said feedback impedance, said emulation transistor connected to supply a current to said emulation impedance, and a current mirror means responsive to the current supplied to said emulation impedance to provide said emulation current, and said supply diode and current mirror means are connected to respectively supply said reference current and said emulation current to said reference circuit output node through said output transistor.

21. The temperature limit circuit of claim 15, said voltage reference circuit comprising a bandgap reference circuit a portion of which produces a voltage with a positive temperature coefficient, wherein said temperature sensing means is implemented by said bandgap reference circuit portion.

22. A temperature limit circuit, comprising:

a temperature sensing means, first comparator means for producing an over-temperature signal when the sensed temperature exceeds an upper set point, second comparator means for producing an under-temperature signal when the sensed temperature falls below a lower set point, and a hysteresis circuit for establishing a hysteresis signal to terminate said over-temperature signal when the sensed temperature falls from said upper set point to a hysteresis differential below said upper set point, and to terminate said under-temperature signal when the sensed temperature increases from said lower set point to a hysteresis differential above said lower set point, said hysteresis circuit including connection nodes for a selectable common impedance circuit the impedance value of which establishes both said upper and lower set points and the value of said hysteresis differentials.

23. A temperature limit circuit, comprising:

a voltage reference circuit having a voltage reference output node for receiving a selectable impedance circuit, said impedance circuit when connected to the voltage reference output node establishing a reference current the magnitude of which is determined by the impedance value of said impedance circuit, a temperature sensitive circuit for producing over-temperature and under-temperature signals when a sensed temperature respectively exceeds and falls below upper and lower temperature set points, a current controlled hysteresis circuit for maintaining said over-temperature and under-temperature signals until the sensed temperature respectively drops below and exceeds said upper and lower set points by a hysteresis differential, and means for establishing a hysteresis current for said hysteresis circuit based upon the magnitude of said reference current after the impedance circuit has been connected, the magnitude of said hysteresis current determining the magnitude of said hysteresis differential.

24. A temperature limit circuit, comprising:

a temperature sensing means, over-temperature and under-temperature comparators, a hysteresis impedance circuit connected in circuit with said temperature sensing means to provide a common temperature input to each of said comparators, a voltage reference circuit having an output reference voltage node for receiving a selectable voltage dividing impedance circuit, said voltage dividing impedance circuit connected to said output reference voltage node drawing therefrom a reference current the magnitude of which is determined by the impedance value of said voltage dividing impedance circuit, means for tapping said voltage dividing impedance circuit after it has been connected to provide over-temperature and under-temperature set points for said over-temperature and under-temperature comparators, respectively, means for establishing a hysteresis current that is based upon said reference current, first and second hysteresis circuit branches, each circuit branch including a current source for supplying said hysteresis current to its respective branch, a diode for transmitting the current from its current source, and a current mirror means on the opposite side of the diode from said current source, the current mirror means for the second branch mirroring the current through the current mirror means for the first branch, means connecting said hysteresis impedance circuit and the common temperature inputs of said comparators to said second branch to receive current from the second branch's diode and to supply current to its current mirror means, and complementary outputs from said comparators connected to inhibit current flow through the diode for one branch when one of said comparator is actuated and to inhibit current flow through the diode for the other branch when the other of said comparators is actuated, and thereby direct hysteresis current flows through said hysteresis impedance circuit which reduces the temperature necessary to de-actuate said over-temperature comparator by a hysteresis differential and increase the temperature necessary to de-actuate said under-temperature comparator by substantially the same hysteresis differential.

* * * * *